US008179043B2

(12) United States Patent
Kawase et al.

(10) Patent No.: US 8,179,043 B2
(45) Date of Patent: May 15, 2012

(54) PLASMA DISPLAY PANEL FREE FROM YELLOWING

(75) Inventors: Akira Kawase, Hyogo (JP); Kazuhiro Morioka, Kyoto (JP); Yui Saitou, Osaka (JP); Shinsuke Yoshida, Hyogo (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 311 days.

(21) Appl. No.: 12/602,569

(22) PCT Filed: Aug. 4, 2008

(86) PCT No.: PCT/JP2008/002099

§ 371 (c)(1),
(2), (4) Date: Dec. 1, 2009

(87) PCT Pub. No.: WO2009/019852

PCT Pub. Date: Feb. 12, 2009

(65) Prior Publication Data

US 2010/0182309 A1 Jul. 22, 2010

(30) Foreign Application Priority Data

Aug. 6, 2007 (JP) ..... 2007-203895
Aug. 6, 2007 (JP) ..... 2007-203896
Aug. 6, 2007 (JP) ..... 2007-203897

(51) Int. Cl.
*H01J 17/49* (2006.01)

(52) U.S. Cl. ..... 313/586

(58) Field of Classification Search ..... 313/582–587
See application file for complete search history.

(56) References Cited

U.S. PATENT DOCUMENTS 5,977,708 A 11/1999 Amatsu et al.
2006/0276322 A1 12/2006 Hasegawa et al.

FOREIGN PATENT DOCUMENTS

| | | |
|---|---|---|
| JP | 9-50769 | 2/1997 |
| JP | 2001-45877 | 2/2001 |
| JP | 2002-53342 | 2/2002 |
| JP | 2003-128430 | 5/2003 |
| JP | 2006-342018 | 12/2006 |
| JP | 2007-39269 | 2/2007 |
| JP | 2007-126319 | 5/2007 |
| JP | 2007-182365 | 7/2007 |
| KR | 10-2007-0051399 | 5/2007 |

OTHER PUBLICATIONS

International Search Report issued Sep. 2, 2008 in International (PCT) Application No. PCT/JP2008/002099.

(Continued)

*Primary Examiner* — Joseph L Williams
(74) *Attorney, Agent, or Firm* — Wenderoth Lind & Ponack, L.L.P.

(57) ABSTRACT

A plasma display panel is formed of a front panel including display electrodes, a dielectric layer, and a protective layer which are formed on a glass substrate, and a rear panel including electrodes, barrier ribs, and phosphor layers all of which are formed on a substrate. The front panel and the rear panel confront each other, and peripheries thereof are sealed to form a discharge space therebetween. The dielectric layer of the front panel contains $Bi_2O_3$ and at least CuO and CoO, and the total content expressed in mole % of CuO and CoO falls within a range from 0.03% to 0.3%.

3 Claims, 1 Drawing Sheet

OTHER PUBLICATIONS

Chinese Office Action issued Jan. 27, 2011 in Application No. 200880018854.5.

Supplementary European Search Report issued Oct. 8, 2010 in Application No. EP 08 79 0363.

Joon-Young Song et al., "Preparation and characterization of CuO doped $Bi_2O_3$-$B_2O_3$-BaO-ZnO glass system for transparent dielectric layer", Journal of Non-Crystalline Solids, North-Holland Physics Publishing, Amsterdam, NL LNKD-DOI:10.1016/J.Jnoncrysol. 2006.05.041, vol. 352, No. 50-51, Dec. 1, 2006, pp. 5403-5407.

Ji-Su Park et al., "Effect of melting temperature and additives on transparency of Bi based Transparent Dielectric Layer in Plasma Display Panel", 5$^{th}$ International Meeting on Information Display, Digest of Technical Papers, Korea, vol. 2, Jul. 1, 2005, pp. 1229-1232.

PLASMA DISPLAY PANEL FREE FROM YELLOWING

This application is a U.S. National Phase Application of PCT International Application PCT/JP2008/002099.

BACKGROUND OF THE INVENTION

Technical Field

The present invention relates to a plasma display panel to be used in a display device.

BACKGROUND ART

A plasma display panel (hereinafter simply referred to as a PDP) allows achieving high definition display and a large-size screen, so that television receivers (TV) with a large screen having as great as 100 inches diagonal length can be commercialized by using the PDP. In recent years, use of the PDP in a high-definition TV, which needs more than doubled scanning lines than conventional NTSC method, has progressed and the PDP free from lead (Pb) is commercialized in order to contribute to environment protection.

The PDP is basically formed of a front panel and a rear panel. The front panel comprises the following elements:

- a glass substrate made of sodium-borosilicate-based float glass;
- display electrodes, formed of striped transparent electrodes and bus electrodes, formed on a principal surface of the glass substrate,
- a dielectric layer for covering the display electrodes and working as a capacitor; and
- a protective layer made of magnesium oxide (MgO) and formed on the dielectric layer.

The rear panel comprises the following elements:

- a glass substrate;
- striped address electrodes formed on a principal surface of the glass substrate,
- a primary dielectric layer for covering the address electrodes;
- barrier ribs formed on the primary dielectric layer; and
- phosphor layers formed between the respective barrier ribs and emitting light in red, green, and blue respectively.

The front panel confronts the rear panel such that its surface mounted with the electrodes faces a surface mounted with the electrodes of the rear panel, and peripheries of both the panels are sealed airtightly to form a discharge space therebetween, and the discharge space is partitioned by the barrier ribs. The discharge space is filled with discharge gas of Ne and Xe at a pressure ranging from 55 kPa to 80 kPa. The PDP allows displaying a color video through this method: Voltages of video signals are selectively applied to the display electrodes for discharging, thereby producing ultra-violet rays, which excite the respective phosphor layers, so that colors in red, green, and blue are emitted, thereby achieving the display of a color video.

The bus electrodes of the display electrodes employ silver electrodes in order to maintain electrical conductivity, and the dielectric layer employs low-melting glass made of mainly lead oxide. However, in recent years, dielectric layers free from lead for contributing to environment protection have been disclosed in, e.g. patent documents 1, 2, 3, and 4.

In recent years, the number of high-definition TV receivers has increased, which requires the PDP to increase the number of scanning lines, and then the number of display electrodes should be increased, so that intervals between the respective display electrodes must be reduced. As a result, the silver electrode forming the display electrode diffuses a greater amount of silver ions into the dielectric layer and the glass substrate. The diffused silver ions undergo reducing action from alkaline metal ions contained in the dielectric layer and divalent tin ions contained in the glass substrate, thereby forming silver colloid. As a result, the dielectric layer and the glass substrate tend to be yellowed or browned more deeply, and yet, silver oxide having undergone the reducing action generates oxygen which incurs air bubbles in the dielectric layer.

The increase in the number of scanning lines thus incurs yellowing in the glass substrate more deeply as well as more air bubbles in the dielectric layer, and those problems degrade the picture quality as well as generate failures in insulation of the dielectric layer.

Patent Document 1: Unexamined Japanese Patent Application Publication No. 2003-128430

Patent Document 2: Unexamined Japanese Patent Application Publication No. 2002-053342

Patent Document 3: Unexamined Japanese Patent Application Publication No. 2001-045877

Patent Document 4: Unexamined Japanese Patent Application Publication No. H09-050769

SUMMARY OF THE INVENTION

A plasma display panel (PDP) of the present invention comprising the following elements:

- a front panel including display electrodes, a dielectric layer, and a protective layer which are formed on a glass substrate; and
- a rear panel including electrodes, barrier ribs, and phosphor layers all of which are formed on a substrate,
- wherein the front panel and the rear panel are faced with each other, and peripheries thereof are sealed to form a discharge space therebetween,
- wherein the dielectric layer contains bismuth oxide ($Bi_2O_3$) and at least CuO and CoO, and the content expressed in mole % of CuO and CoO in total falls within the range from 0.03% to 0.3%.

The foregoing structure allows the PDP to be free from yellowing, and yet to maintain a linear transmission, to be easy on the environment, and to maintain high brightness as well as high reliability.

| DESCRIPTION OF REFERENCE MARKS | |
|---|---|
| 1 | PDP |
| 2 | front panel |
| 3 | front glass substrate |
| 4 | scan electrode |
| 4a, 5a | transparent electrode |
| 4b, 5b | metal bus electrode |
| 5 | sustain electrode |
| 6 | display electrode |
| 7 | black stripe (lightproof layer) |
| 8 | dielectric layer |
| 9 | protective layer |

-continued

| DESCRIPTION OF REFERENCE MARKS | |
|---|---|
| 10 | rear panel |
| 11 | rear glass substrate |
| 12 | address electrode |
| 13 | primary dielectric layer |
| 14 | barrier rib |
| 15 | phosphor layer |
| 16 | discharge space |

DETAILED DESCRIPTION OF THE INVENTION

The PDP in accordance with an exemplary embodiment of the present invention is demonstrated hereinafter with reference to the accompanying drawings.

Exemplary Embodiment

Figure 1:
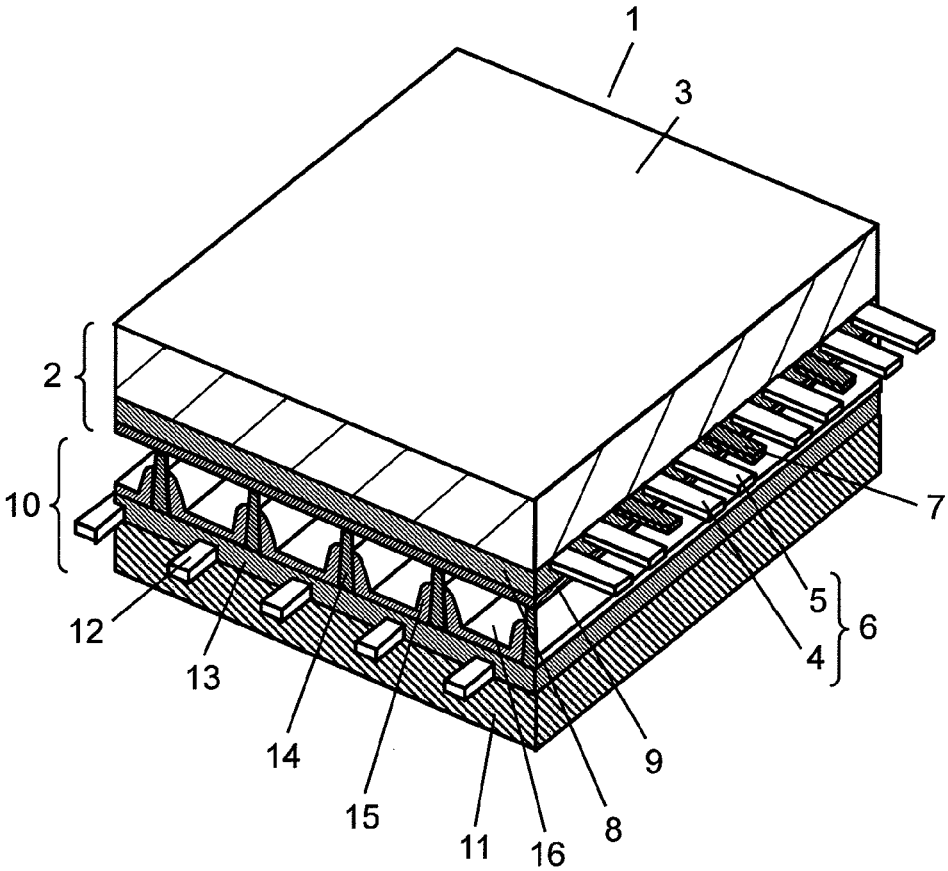
FIG. 1 shows a perspective view illustrating a structure of a PDP in accordance with an exemplary embodiment of the present invention.

FIG. 1 shows a perspective view illustrating a structure of the PDP in accordance with the embodiment of the present invention. The PDP is basically structured similarly to a PDP of AC surface discharge type generally used. As shown in FIG. 1, PDP 1 is formed of front panel 2, which includes front glass substrate 3, and rear panel 10, which includes rear glass substrate 11. Front panel 2 and rear panel 10 confront each other and the peripheries thereof are airtightly sealed with sealing agent such as glass frit, thereby forming discharge space 16, which is filled with discharge gas of Ne and Xe at a pressure falling in a range between 55 kPa and 80 kPa.

Multiple pairs of belt-like display electrodes 6 formed of scan electrode 4 and sustain electrode 5 are placed in parallel with multiple black stripes (lightproof layer) 7 on front glass substrate 3 of front panel 2. Dielectric layer 8 working as a capacitor is formed on front glass substrate 3 such that layer 8 can cover display electrodes 6 and lightproof layers 7. On top of that, protective layer 9 made of magnesium oxide (MgO) is formed on the surface of dielectric layer 8.

Multiple belt-like address electrodes 12 are placed in parallel with each other on rear glass substrate 11 of rear panel 10, and they are placed along a direction crossing at right angles with scan electrodes 4 and sustain electrodes 5 formed on front panel 2. Primary dielectric layer 13 covers those address electrodes 12. Barrier ribs 14 having a given height are formed on primary dielectric layer 13 between respective address electrodes 12 for partitioning discharge space 16. Phosphor layers 15 are applied, in response to respective address electrodes 12, onto grooves formed between each one of barrier ribs 14. Phosphor layers 15 emit light in red, blue, and green with an ultraviolet ray respectively. A discharge cell is formed at a junction point where scan electrode 14, sustain electrode 15 and address electrode 12 intersect with each other. The discharge cells having phosphor layers 15 of red, blue, and green respectively are placed along display electrodes 6, and these cells work as pixels for color display.

Figure 2:
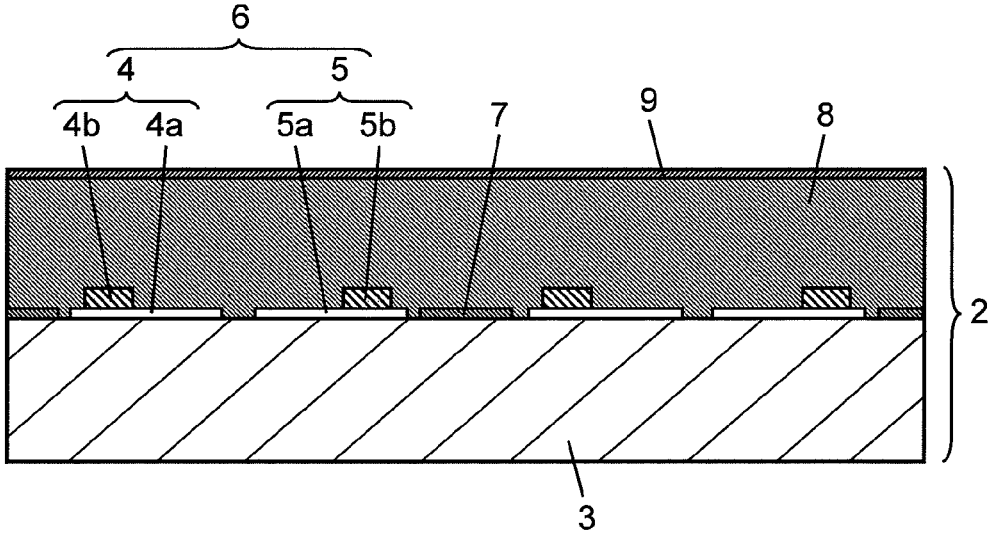
FIG. 2 shows a sectional view illustrating a structure of a front panel of the PDP shown in FIG. 1.

FIG. 2 shows a sectional view illustrating a structure of front panel 2, which includes dielectric layer 8, of the PDP in accordance with this embodiment. FIG. 2 shows front panel 2 upside down from that shown in FIG. 1. As shown in FIG. 2, display electrode 6 formed of scan electrode 4 and sustain electrode 5 is patterned on front glass substrate 3 manufactured by the float method. Black stripe 7 is also patterned together with display electrode 6 on substrate 3. Scan electrode 4 and sustain electrode 5 are respectively formed of transparent electrodes 4*a*, 5*a* made of indium tin oxide (ITO) or tin oxide ($SnO_2$), and of transparent electrodes 4*b*, 5*b* employing metal bus electrodes 4*b*, 5*b* formed on electrodes 4*a*, 5*a*. Metal bus electrodes 4*b*, 5*b* give electrical conductivity to transparent electrodes 4*a*, 5*a* along the longitudinal direction of electrodes 4*a*, 5*a*, and they are made of conductive material of which main ingredient is silver (Ag).

Dielectric layer 8 covers transparent electrodes 4*a*, 5*a* and metal bus electrodes 4*b*, 5*b* and black stripes 7 formed on front glass substrate 3, and protective layer 9 is formed on dielectric layer 8.

Next, a method for manufacturing the PDP is demonstrated hereinafter. First, form scan electrodes 4, sustain electrodes 5, and lightproof layer 7 on front glass substrate 3. Scan electrode 4 and sustain electrode 5 are respectively formed of transparent electrodes 4*a*, 5*a* and metal bus electrodes 4*b*, 5*b*. These electrodes 4*a*-5*b* are patterned with a photo-lithography method. Transparent electrodes 4*a*, 5*a* are formed by using a thin-film process, and metal bus electrodes 4*b*, 5*b* are made by firing the paste containing silver (Ag) at a desirable temperature before the paste is hardened. Light proof layer 7 is made by screen-printing the paste containing black pigment, or by forming the black pigment on the entire surface of the glass substrate, and then patterning the pigment with the photolithography method before the paste is fired.

Next, apply dielectric paste onto front glass substrate 3 with a die-coating method such that the paste can cover scan electrodes 4, sustain electrodes 5, and lightproof layer 7, thereby forming a dielectric paste layer (dielectric material layer). Then leave front glass substrate 3, on which dielectric paste is applied, for a given time, so that the surface of the dielectric paste is leveled to be flat. Then fire and harden the dielectric paste layer for forming dielectric layer 8 which covers scan electrodes 4, sustain electrodes 5 and lightproof layer 7. The dielectric paste is a kind of paint containing binder, solvent, and dielectric material such as glass powder.

Next, form protective layer 9 made of magnesium oxide (MgO) on dielectric layer 8 with a vacuum deposition method. The foregoing steps allow forming a predetermined structural elements (scan electrodes 4, sustain electrodes 5, lightproof layer 7, dielectric layer 8 and protective layer 9) on front glass substrate 3, so that front panel 2 is completed.

Rear panel 10 is formed this way: First, form a material layer, which is a structural element of address electrode 12, by screen-printing the paste containing silver (Ag) onto rear glass substrate 11, or by patterning with the photolithography method a metal film which is formed in advance on the entire surface of substrate 11. Then fire the material layer at a given temperature, thereby forming address electrode 12. Next, form a dielectric paste layer on rear glass substrate 11, on which address electrodes 12 are formed, by applying dielectric paste onto substrate 11 with the die-coating method such that address electrodes 12 can be covered with the dielectric paste layer. Then fire the dielectric paste layer for forming primary dielectric layer 13. The dielectric paste is a kind of paint containing binder, solvent, and dielectric material such as glass powder.

Next, apply the paste containing the material for barrier rib onto primary dielectric layer 13, and pattern the paste into a given shape, thereby forming a barrier-rib layer. Then fire this barrier-rib layer for forming barrier ribs 14. The photolithography method or a sand-blasting method can be used for patterning the paste pained onto primary dielectric layer 13. Next, paint the phosphor paste containing phosphor material onto primary dielectric layer 13 surrounded by barrier ribs 14 adjacent to each other and also onto lateral faces of barrier ribs 14. Then fire the phosphor paste for forming phosphor layer 15. The foregoing steps allow completing rear panel 10 including the predetermined structural elements on rear glass substrate 11.

Front panel 2 and rear panel 10 discussed above are placed confronting each other such that scan electrodes 4 cross with address electrodes 12 at right angles, and the peripheries of panel 2 and panel 10 are sealed with glass frit to form discharge space 16 therebetween, which is filled with discharge gas including Ne, Xe. PDP 1 is thus completed.

Next, dielectric layer 8 of front panel 2 is detailed hereinafter. Dielectric layer 8 needs a high dielectric strength, and yet, it needs a high light transmittance. These properties largely depend on the composition of the glass component contained in dielectric layer 8. A conventional way of forming dielectric layer 8 is this: Paste is painted to front glass substrate 3, on which display electrodes 6 are formed, with the screen-printing method or the die-coating method. The paste contains glass powder component and binder component formed of solvent including resin, plasticizer, and dispersant. Front glass substrate 3 is then dried and fired at 450-600° C. Here is another known method: This paste is applied onto a film, and dried, then transcribed onto front glass substrate 3, on which display electrodes 6 have been formed, before it is fired at 450-600° C.

The glass component of layer 8 has contained lead oxide (PbO) more than 20 mole % in order to allow the firing at 450-600° C. However, in recent years, lead-free glass has been available for the purpose of environment protection, and this glass contains bismuth oxide ($Bi_2O_3$) instead of lead oxide, and the content expressed in mole % of $Bi_2O_3$ falls within the range from 5 to 40%.

The PDP in accordance with this embodiment of the present invention contains not only $Bi_2O_3$ in its dielectric layer but also at least CaO and BaO, where the content expressed in mole % of CaO is greater than BaO. The glass material for the dielectric layer contains CaO greater than BaO in mole %. What is more, the glass material contains $K_2O$ and at least one $R_2O$ (R is at least one selected from the group consisting of Li, Na). The content expressed in mole % of $K_2O$ is greater than the total content of $Li_2O$ and $Na_2O$ in the glass material. The content expressed in mole % of $MoO_3$ in the glass material is not greater than 2%. Finally the content expressed in mole % of $Bi_2O_3$ in the glass material is not greater than 5%.

The dielectric material formed of the foregoing composition is grinded by a wet jet mill or a ball mill into powder of which average particle diameter is 0.5 μm-3.0 μm. Next, this dielectric powder of 50-65 wt % and binder component of 35-50 wt % are mixed with a three-roll mill, so that dielectric paste to be used in the die-coating or the printing can be produced.

The binder component is formed of terpinol or butyl carbitol acetate which contains ethyl-cellulose or acrylic resin of 1 wt %-20 wt %. The paste can contain, upon necessity, plasticizer such as dioctyl phthalate, dibutyl phthalate, triphenyl phosphate, tributyl phosphate, and dispersant such as glycerop mono-oleate, sorbitan sesquio-leate, alkyl-allyl based phosphate for improving the printing performance.

Next, the dielectric paste discussed above is applied to front glass substrate 3 with the die-coating method or the screen-printing method such that the paste covers display electrodes 6, before the paste is dried. The paste is then fired at 575-590° C. a little bit higher than the softening point of the dielectric material.

A brightness of PDP advantageously increases and a discharge voltage also advantageously lowers at a thinner film thickness of dielectric layer 8, so that the film thickness is desirably set as thin as possible insofar as the dielectric voltage is not lowered. Considering these conditions and a visible light transmittance, the film thickness of dielectric layer 8 is set not greater than 41 μm in this embodiment.

Use of the foregoing dielectric layer 8 allows the PDP in accordance with this embodiment to maintain a high brightness as well as high reliability in the high-definition display application, and on top of that, the PDP easy on the environment is achievable.

The material composition of dielectric layer 8 of the PDP in accordance with this embodiment is detailed hereinafter. First, the content of $Bi_2O_3$ and the addition of $R_2O$ are described. In this embodiment, $Bi_2O_3$ is used as a replacement of lead component in dielectric glass. Increasing the content of $Bi_2O_3$ in the dielectric glass will lower the softening point of the dielectric glass, and this property produces various advantages in the manufacturing process. However, since Bi-based material is expensive, increasing the content of $Bi_2O_3$ will boost the material cost.

Decreasing the content of Bi-based material will raise the softening point of the dielectric glass, and the firing thus should be done at a higher temperature, which will prompt the silver electrodes forming the display electrodes to diffuse a greater amount of silver ions. A greater amount of silver becomes colloidal, which incurs coloring of the dielectric layer or producing air-bubbles, and resultantly degrades the picture quality of the PDP or invites a failure in insulating the dielectric layer.

The present invention focuses on Li, Na, K, Rb, or Cs selected from alkali metals as a replacement of Bi-based material. If the dielectric glass contains some alkali metal oxide, the softening point of the glass lowers, so that the content of Bi-based material can be reduced while the softening point of the glass is lowered, thereby benefiting the manufacturing process in various ways.

However, if the glass contains too much amount of alkali metal oxide, the reduction of sliver ions, which diffuses from the silver electrodes forming the display electrodes, is accelerated, so that colloidal silver is formed in a greater amount. As a result, coloring of the dielectric layer or the production of air-bubbles occurs, which incurs degradation in picture quality of the PDP or a failure in insulation of the dielectric layer.

In this embodiment, the content expressed in mole % of $R_2O$ in the glass falls within a range of 1-9% because the content over 1% will suppress the yellowing of the dielectric layer while the content over 9% will vary a dielectric constant greatly for producing failures in displaying a video. The content expressed in mole % of $Bi_2O_3$ can be reduced to as low as 1-5%.

What is more in this embodiment, two or more than two kinds of "R"s of $R_2O$ (R is the one selected from Li, Na, K) are contained in dielectric layer 8 because of the following reason: front glass substrate 3, in general, contains much of $K_2O$ and $Na_2O$, and the firing of dielectric layer 8 at a high temperature, e.g. not lower than 550° C., prompts the $R_2O$ contained in the dielectric glass to exchange alkali metal ions ($Li^+$, $Na^+$, $K^+$) with $Na_2O$ contained in front glass substrate 3, namely, ion-exchange occurs.

Each one of those alkali metal ions ($Li^+$, $Na^+$, $K^+$) influences differently to the thermal expansion coefficient of glass substrate 3, so that the ion-exchange occurring during the firing of dielectric layer 8 will make difference in thermally contracted amount between front glass substrate 3 around dielectric layer 8 and the other parts of glass substrate 3. As a result, front glass substrate 3 produces a large warp on its surface where dielectric layer 8 is formed.

This embodiment of the present invention; however, contains two or more than two kinds of $R_2O$ in dielectric layer 8, so that the difference in thermally contracted amount hardly occurs even when the firing produces the ion-exchange, so that the warp of front glass substrate 3 can be reduced. As a result, not only the amount of $Bi_2O_3$ in mole % can be reduced to as little as not greater than 5%, but also the warp of front glass substrate 3 can be reduced.

Next, the type and the amount of $R_2O$ to be added are detailed hereinafter. The oxide to be added as $R_2O$ must include $K_2O$, and preferably includes either one of $Li_2O$ or $Na_2O$, or both of $Li_2O$ and $Na_2O$. The oxide discussed above allows preventing the thermal expansion coefficient of front glass substrate 3 from varying greatly even if the ion-exchange occurs. As a result, a large warp of substrate 3 where dielectric layer 8 is formed can be prevented.

A greater content expressed in mole % of $K_2O$ in the dielectric glass than the total content of $Li_2O$ and $Na_2O$ in the dielectric glass positively reduces a change in the thermal expansion coefficient of front glass substrate 3, and thus reduces the warp of glass substrate 3.

As discussed above, $R_2O$ indeed allows lowering the softening point of the dielectric glass, but the alkali metal oxide represented by $R_2O$ accelerates the reducing action of silver ions diffused from the silver electrodes forming display electrodes 6. A more amount of colloidal silver is thus produced, which incurs coloring of dielectric layer 8 as well as production of air bubbles in layer 8. As a result, the picture quality of the PDP is degraded, or a failure in insulating dielectric layer 8 occurs.

In order to suppress the reducing action of silver ions due to the presence of $R_2O$, this embodiment of the present invention adds CuO and CoO to the dielectric glass. On top of that, $MoO_3$ is added for decreasing the amount of colloidal silver. The works of those additives are demonstrated hereinafter.

First, CuO undergoes the reducing action and turned into $Cu_2O$ during the firing of dielectric layer 8, thereby suppressing the reducing action of silver ions ($Ag^+$). As a result, yellowing of layer 8 can be suppressed. On the other hand, CuO is found permitting the dielectric glass to color in blue while. $Cu_2O$ permits the dielectric glass to color in green, so that the causes of these colorings are clarified as discussed in the following paragraphs for solving these coloring problems.

The manufacturing of PDPs needs multiple firing steps including an assembly step. The reduction of CuO into $Cu_2O$ is subject to the atmospheric condition such as oxygen density during the firing, and it is hard to control a degree of the reduction. These properties of the reduction invite variation in coloring the surface of PDP because much progress in the reduction of CuO permits a part of the surface to color in blue rather strongly while less progress in the reduction of CuO permits another part of the surface to color in green strongly. This variation in the coloring incurs unevenness in brightness as well as in chromaticity, so that the picture quality is degraded.

Thus CoO is added to the dielectric glass in order to suppress the foregoing variation in coloring due to the reduction of CuO. This CoO also effects coloring the dielectric glass in blue as CuO does; however, the addition of CoO allows the dielectric glass to color in blue more steadily, so that the picture quality of the PDP can be improved.

If the total amount of the additives of CuO and CoO exceeds 0.3 mole %, the dielectric glass colors in blue too strongly, so that the picture quality of PDP is degraded contrary to the expectation. If CoO is solely added to the dielectric glass, the reduction of the silver ions cannot be suppressed, and what is worse, the visible light transmittance of dielectric layer 8 is lowered. If the total amount of the additives of CuO and CoO is not greater than 0.3 mole %, the dielectric glass colors in blue optimally, so that excellent picture quality of PDP can be expected.

The optimum amount of additives is this: the total content expressed in mole % of the added CuO and CoO preferably falls within the range of 0.03-0.3%. The content of only 0.03% will allow producing the foregoing advantage; however, the content over 0.3% will incur too much coloring in blue, so that the picture quality of PDP is degraded contrary to the expectation. If CoO is solely added, the reduction of silver ions cannot be suppressed, and what is worse, the linear transmission of the dielectric layer is lowered. When the total content expressed in mole % of the added CuO and CoO is not greater than 0.3%, dielectric layer 8 colors in blue optimally, and excellent picture quality of PDP can be expected.

Next, an amount of CaO to be added is described hereinafter. As discussed previously, CaO allows suppressing the reduction of silver ions ($Ag^+$), thereby decreasing the yellowing. The CaO works here as an oxidizing agent. The dielectric glass containing CaO unfortunately lowers the visible light transmittance, in particular, the linear transmission that affects a degree of the definition of display. This embodiment of the present invention thus replaces CaO in parts with BaO which is expected to increase the linear transmission.

However, BaO accelerates the reduction of the silver ions ($Ag^+$) and incurs the yellowing. It is thus important to add BaO less than the amount of CaO in mole %, so that the addition of BaO can prevent the yellowing with the linear transmittance maintained.

Next, an addition of $MoO_3$, which suppresses the production of colloidal silver as discussed previously, is described hereinafter. The addition of $MoO_3$ to the dielectric glass containing $Bi_2O_3$ tends to produce a stable chemical compound, such as $Ag_2MoO_4$, $Ag_2Mo_2O_7$, $Ag_2Mo_4O_{13}$, at a temperature as low as not higher than 580° C.

In this embodiment, since dielectric layer 8 is fired at a temperature ranging from 550 to 590° C., the silver ions ($Ag^+$) diffused into layer 8 during the firing reacts with $MoO_3$ in layer 8, thereby producing a stable compound, and thus the silver ions become stable. In other words, the silver ions ($Ag^+$) are stabilized without the reduction thereof, so that no cohering colloidal silver is produced. Oxygen production associated with the production of colloidal silver thus becomes small, so that only a small amount of air-bubbles is produced in dielectric layer 8. $MoO_3$ can be replaced with $WO_3$, $CeO_2$, or $MnO_2$ which is added instead, while the advantage similar to what is discussed above can be maintained.

A content expressed in mole % of $MoO_3$ preferably falls within a range from not lower than 0.1 to not greater than 2%. The content of over 0.1% allows improving the number of air-bubbles and the yellowing; however, the content of over 2% makes the dielectric glass tend to be crystallized when the glass is fired. As a result, the dielectric glass becomes cloudy and cannot maintain its transparence, and the visible light transmittance thus lowers, which degrades the picture quality of the PDP. The content of less than 2%, on the other hand, makes the dielectric glass resist being crystallized, so that no degradation in the picture quality is expected.

The foregoing composition of dielectric layer 8 of PDP in accordance with the embodiment allows suppressing the yellowing as well as air-bubble production even when dielectric layer 8 is formed on metal bus electrodes 4*b*, 5*b* made of silver (Ag), and yet the foregoing structure allows suppressing the warp of the front glass substrate. On top of that, dielectric layer 8 having the foregoing structure allows the dielectric glass to achieve a high light transmittance as well as to be colored uniformly. The PDP of high light transmittance and having little yellowing and few air-bubbles is thus achievable.

A PDP, of which discharge cells have the following physical dimensions, is produced to be adaptable to a 42-inch high-definition TV.

height of barrier rib: 0.15 mm interval between barrier ribs (cell pitch): 0.15 mm interval between display electrodes: 0.06 mm The foregoing discharge cell is filled with Ne—Xe based mixed gas in which Xe gas is contained at 15 volume-content % under the pressure of 60 kPa. The PDP discussed above is used in the following experiments with the composition of the dielectric layer being varied.

Experiment 1

Table 1 shows the material composition of the dielectric glass of dielectric layer 8.

TABLE 1

| Dielectric glass Composition mole % | Exp. 1 | Exp. 2 | Comp. 1 | Comp. 2 | Comp. 3 | Comp. 4 | Comp. 5 | Comp. 6 | Comp. 7 | Comp. 8 | Comp. 9 |
|---|---|---|---|---|---|---|---|---|---|---|---|
| $Bi_2O_3$ | 3.0% | 3.0% | 3.0% | 3.0% | 3.0% | 3.0% | 3.0% | 3.0% | 3.0% | 3.0% | 3.0% |
| CaO | 3.0% | 3.0% | 4.0% | 2.0% | 1.0% | 3.0% | 3.0% | 3.0% | 3.0% | 3.0% | 3.0% |
| BaO | 1.0% | 1.0% | — | 2.0% | 3.0% | 1.0% | 1.0% | 1.0% | 1.0% | 1.0% | 1.0% |
| $K_2O$ | 5.0% | 5.0% | 7.0% | 5.0% | 5.0% | 5.0% | — | 2.0% | 5.0% | 5.0% | 5.0% |
| $Na_2O$ | 2.0% | 2.0% | — | 2.0% | 2.0% | 2.0% | 2.0% | 4.0% | 2.0% | 2.0% | 2.0% |
| $Li_2O$ | — | — | — | — | — | — | 5.0% | 1.0% | — | — | — |
| CoO | 0.1% | 0.1% | — | — | — | 0.2% | 0.1% | 0.1% | 0.1% | 0.2% | — |
| CuO | 0.1% | 0.2% | 0.3% | 0.3% | 0.3% | 0.3% | 0.2% | 0.2% | 0.2% | — | — |
| $MoO_3$ | 0.7% | 0.7% | 0.7% | 0.7% | 0.7% | 0.7% | 0.7% | 0.7% | 2.5% | 0.7% | 0.7% |
| Others | 85.1% | 85.0% | 85.0% | 85.0% | 85.0% | 84.8% | 85.0% | 85.0% | 83.2% | 85.1% | 85.3% |

Exp: experiment,
Comp: comparison

The PDP is produced, of which dielectric layer 8 includes the dielectric glass having the material composition shown in table 1. The bottom line shows "Others" indicating other materials free from lead, such as zinc oxide (ZnO), boron oxide ($B_2O_3$), silicon dioxide ($SiO_2$), aluminum oxide ($Al_2O$), and their contents are not specified here, but the contents can fall within the range specified by conventional art.

To evaluate the properties of the PDP formed of the foregoing dielectric glass, the PDP is tested for the following items. The test result is shown in table 2.

TABLE 2

| | | Exp. 1 | Exp. 2 | Comp. 1 | Comp. 2 | Comp. 3 | Comp. 4 | Comp. 5 | Comp. 6 | Comp. 7 | Comp. 8 | Comp. 9 |
|---|---|---|---|---|---|---|---|---|---|---|---|---|
| Linear transmittance (%) | | 71.2 | 73.6 | 67.7 | 82.7 | 74.5 | 71.9 | 71.7 | 71.4 | 55.8 | 69.2 | 70.0 |
| Yellowing (b* value) | Aver | 1.8 | 1.7 | 1.8 | 5.6 | 2.6 | 1.8 | 2.1 | 2.0 | 2.0 | 1.9 | 6.2 |
| | Max. | 2.0 | 2.0 | 2.3 | 6.1 | 3.4 | 2.1 | 2.3 | 2.2 | 2.3 | 2.1 | 6.4 |
| Wavelength dependency (%) | | 1.0 | 1.9 | 2.1 | 1.7 | 1.8 | 3.1 | 1.4 | 1.5 | 1.3 | 1.1 | 0.9 |
| Residual stress (MPa) | | −0.8 | −0.7 | −1.0 | −0.4 | −0.6 | −0.7 | 3.4 | 1.5 | −0.7 | −0.8 | −0.9 |

First, the transmittance of front panel 2 is measured with a Haze Meter. Other factors, e.g. the transmittance of front glass substrate 3 and scan electrodes 4 are deducted from the measurement results, then the practical results are used as the transmittance of dielectric layer 8. The linear component of this practical transmittance, i.e. linear transmittance is compared with the comparisons 1-9. The linear transmittance is preferably over 70%, and less than 70% is not preferable because it will lower the brightness of PDP.

A degree of yellowing is measured with a colorimeter (made by Konica-Minolta Inc. Model No. CR-300) for obtaining b* values at nine points on the surface of PDP. The average and the max. values of the b* values are used for the comparisons. Table 2 shows the comparison result. The b* value indicates how much the yellowing affects the display performance of PDP, and the threshold is b*=3. The yellowing becomes more conspicuous at a greater value of b*, and the color temperature lowers accordingly, which is not favorable to the PDP.

Next, the transmittance of front panel 2 is measured with a spectrophotometric colormetry meter (made by Konica-Minolta Inc. Model No. CM-3600) in order to evaluate a degree of pigmentation of the dielectric material. Other factors such as the transmittance of front glass substrate 3 and scan electrodes 4 are deducted from the measurement results, then the practical results are used as the transmittance of dielectric layer 8. On top of that, a transmittance at wavelength of 660 nm is deducted from a transmittance at wavelength of 550 nm, and this deduction result is used for the comparison of a wavelength dependency of the transmittance. The wavelength dependency of the PDP is preferably not greater than 2%, and if it exceeds 2%, a degree of whiteness of the front panel will lower, which is not favorable to the PDP.

Residual stress of the substrate is measured with a polariscope in order to evaluate a warp thereof due to the presence of the dielectric glass. The polariscope can measure the residual stress in front glass substrate 3, where the residual stress remains due to distortion caused by the glass component. This measuring method is disclosed in, e.g. Unexamined Japanese Patent Application Publication No. 2004-067416, and the method is thus well known. The measured residual stress is expressed in table 2 with a plus symbol (+) when compression stress exists in front glass substrate 3, and with a minus symbol (−) when tensile stress exists in substrate 3. The PDP preferably has residual stress expressed with the minus symbol (−) because if it has plus (+) residual stress, then the tensile stress occurs in dielectric layer 8 to the contrary, so that the strength of layer 8 lowers.

The result shown in table 2 is detailed here. The linear transmittances of comparisons 1, 7 and 8 are less than 70% because of no BaO, too much $MoO_3$, or no CuO as shown in table 1. Comparison 2 has a rather high linear transmittance 82.7%; however, its b* value is as high as 5.6, which is not favorable, because too much BaO is included. Comparison 3 contains no CoO as shown in table 1, so that average of b* value is 2.6, i.e. less than 3.0, however, max. of b* value is 3.4, which makes the dispersion too wide, and it is not favorable to PDP. Comparison 4 contains CoO and CuO in total as much as 0.5%, so that the wavelength dependency of the transmittance is as high as 3.1%, which is not favorable. Comparisons 5, 6 include no $K_2O$ as shown in table 1, or the amount of $K_2O$ is less than the total amount of $Na_2O$ and $Li_2O$, so that the value of residual stress is not favorable. Comparison 9 does not contain CuO or CoO as shown in table 1, so that its b* value is great, which is not favorable to PDP.

Experiments 1 and 2 of the PDP, which uses foregoing dielectric layer 8, include the dielectric glass of a proper material composition, so that the favorable evaluations are obtained as shown in table 2.

The inventors have carried out separately a measurement about the dependency on the content of $MoO_3$. According to this measurement, the b* value in the nine points on the surface of PDP that contains no $MoO_3$ is averagely over 4.0, while the b* value of PDP, which contains 0.1% of $MoO_3$ with the other composition remaining unchanged, is improved down to 2.0. The b* value and the number of air-bubble show a good result when the b* value increases up to 0.7%. However, when the content of $MoO_3$ exceeds 2%, the dielectric layer of PDP becomes cloudy, so that the transmittance lowers greatly.

As discussed above, the exemplary embodiment of the present invention achieves dielectric layer 8 having a high linear transmittance of visible light as well as an optimum b* value, and suppresses a warp of the substrate, and what is more, the PDP free from lead and easy on the environment can be used.

Experiment 2

How much the contents of $Bi_2O_3$ and $R_2O$ in the dielectric glass affect the yellowing, in particular, is studied in detail hereinafter. Table 3 shows the material composition of the dielectric glass of dielectric layer 8 used in this experiment 2. Table 3 also shows b* values measured with the colorimeter (made by Konica-Minolta, Model No. CR-300). The b* value indicates how much the yellowing affects the display performance of PDP, and the threshold is b*=3. The yellowing becomes more conspicuous at a greater value of b*, and the color temperature lowers accordingly, which is not favorable to the PDP.

TABLE 3

| | Exp. 1 | Exp. 2 | Exp. 3 | Comp. 1 | Comp. 2 |
|---|---|---|---|---|---|
| $Bi_2O_3$ Composition of dielectric (mole %) | 3.1% | 1.0% | 3.7% | 0% | 5.2% |
| $R_2O$ Composition of dielectric (mole %) | 8.6% | 7.8% | 4.0% | 9.3% | 0% |
| Yellowing (b* value) Average | 1.8 | 2.7 | 1.2 | 5.1 | 7.0 |

In table 3, comparison 1 contains no $Bi_2O_3$ but much $R_2O$, so that its b* value increases to as great as 5.1, while comparison 2 includes some $Bi_2O_3$ but no $R_2O$, so that its b* value increases to also as great as 7.0.

On the other hand, the dielectric glasses used in experiments 1, 2 and 3 contain $Bi_2O_3$ and $R_2O$ according to the description of the exemplary embodiment of the present invention, and they result in favorable evaluations. The inventors have studied a lower limit of the content of $R_2O$, and found that the content of at least 1% allows lowering the softening point of the dielectric glass with the warp of substrate being suppressed.

The exemplary embodiment of the present invention thus proves that the PDP having an optimal b* value, and yet, being free from lead as well as easy on the environment is achievable.

The PDP of the present invention is free from yellowing in the dielectric layer, and easy on the environment, and excellent in display quality, so that it is useful as a display device of a large-size screen.

The invention claimed is:

1. A plasma display panel, comprising:

a front panel including display electrodes, a dielectric layer, and a protective layer which are formed on a glass substrate; and a rear panel including electrodes, barrier ribs, and phosphor layers all of which are formed on a substrate, wherein the front panel and the rear panel confront each other, and peripheries thereof are sealed to form a discharge space therebetween, the dielectric layer contains $Bi_2O_3$ and at least CuO and CoO, and a total content expressed in mole % of CuO and CoO falls within a range from 0.03% to 0.3%, the dielectric layer contains at least two kinds of $R_2O$, where R is selected from the group consisting of Li, Na, and K, one kind of the $R_2O$ is $K_2O$, where R is selected from the group consisting of Li, Na, and K and a content expressed in mole % of $K_2O$ is greater than a total amount of contents of $Li_2O$ and $Na_2O$.

2. The plasma display panel of claim 1, wherein a total amount of contents expressed in mole % of the $R_2O$, where R is selected from the group consisting of Li, Na, and K, falls within a range from 1% to 9%.

3. The plasma display panel of claim 1, wherein a content expressed in mole % of $Bi_2O_3$ falls within a range from 1% to 5%.

* * * * *